US005315948A

United States Patent [19]

Brown

[11] Patent Number: 5,315,948

[45] Date of Patent: May 31, 1994

[54] LUFF PAD FOR ROLLER REEFING AND FURLING SAILS

[75] Inventor: Hayden D. Brown, Marblehead, Mass.

[73] Assignee: Sail Systems, Inc., Marblehead, Mass.

[21] Appl. No.: 772,885

[22] Filed: Oct. 8, 1991

[51] Int. Cl.[5] ..... B63H 9/04

[52] U.S. Cl. ..... 114/106; 114/107

[58] Field of Search ..... 114/102, 103, 39.1, 114/104, 105, 106, 107, 108, 109

[56] References Cited

U.S. PATENT DOCUMENTS

| | | | |
|---|---|---|---|
| 4,196,687 | 4/1980 | Newick | 114/106 |
| 4,671,200 | 6/1987 | Nakamura | 114/106 |
| 4,748,926 | 6/1988 | Perini | 114/104 |

FOREIGN PATENT DOCUMENTS

| | | | |
|---|---|---|---|
| 2557852 | 1/1984 | France | 114/104 |
| 2113636 | 8/1983 | United Kingdom | 114/104 |

OTHER PUBLICATIONS

HAARSTICK, Quilt-Cut Cruiser, Publication, Oct. 15, 1987, Rochester, N.Y. 14621.

HILD 10-40, Oct. 15, 1987, City Island, N.Y., 10464.

*Primary Examiner*—David M. Mitchell

*Assistant Examiner*—Stephen P. Avila

*Attorney, Agent, or Firm*—Waldron & Associates

[57] ABSTRACT

A luff roller reefing and roller furling sail is provided with a luff pad (6) made up of a laminate of a sail fabric (1) adhesively bonded to a polyurethane elastomeric foam (3). The pad is then adhesively bonded and/or stitched to the length of the luff of a sail (5), tapered from mid-luff to the tack and head. A luff tape is preferably adhesively bonded and stitched over each face of the laminate. When the sail is furled, the tapered luff pad provides bulk to cause more fabric to be drawn from the central portion of the sail, reducing draft and controlling position of the draft in partially furled conditions, and maintaining aerodynamically sound shape in the sail for windward performance.

11 Claims, 1 Drawing Sheet

LUFF PAD FOR ROLLER REEFING AND FURLING SAILS

BACKGROUND

Roller furling and roller reefing (partial furling) of sails has come to be common and popular on a substantial variety of sailing vessels, and permits effective sail handling with reduced crew requirements and a host of other advantages.

In such systems, the sail is supported on and fixed to a stay which is adapted to rotate. When the sail is in place, it will be furled by being rolled around the outside of the rotatable stay. When fully rolled up, or furled, the sail may be left in place, ready for immediate use, not requiring stowage below decks, or crew handling to get it there. Unfurling is rapid and undemanding, so that making sail and getting under weigh is facilitated.

A wide variety of roller furling systems are known in the art, and do not per se form a part of the present invention, which is suitable for use with any such system.

Roller furling systems are also frequently employed in partially furled condition to reef the sail. In increased winds, where the sail area is greater than desirable, roller reefing is effective to reduce sail area, heeling moment, leeway, and to preserve control, particularly steering control, of the vessel. Roller reefing is progressive, and adaptable to wind and wave conditions as they occur. The alternative to reefing is to change to a smaller sail, which is demanding of crew, and in some conditions working on the bow is hazardous. Other reefing techniques for headsails are not generally desirable, and represent little or no improvement on changing sails.

It is characteristic of such roller furling systems that as the luff of the sail is rolled on its stay, luff tension on the sail is decreased, and to a degree the bulk of material in the structure of the foot and leach of the sail cause the volume of material rolled around the stay to be greatest at the tack and the head. As a consequence, the sail develops excessive sag and draft in the center, and the location of the maximum draft moves aft. The problem is exacerbated by bias stretch of the sail fabric, which is ordinarily least controllable in the central portions of the sail structure. These aspects of roller furling are counter productive, as the shape of the sail is less effective, particularly for sailing to windward. Heeling moments remain higher than desirable, and boat performance is lost.

It has long been recognized that increasing the bulk of the roll in the mid-region of the luff of the sail as it is partially furled can alleviate much of the problem, and make roller reefing a far more effective technique. It is also known that the increased bulk of the furled sail on the stay is aerodynamically superior to the sag and stretch of the sail.

Such expedients as enlarging the central, mid-luff portion of the stay, or hoisting an elongated member along the luff to become rolled into the sail as the furling takes place have been tried. The enlarged stay is aerodynamically undesirable. The hoisting of a luff "partner" is a backward step, since it puts the crew back on the bow of the vessel in dangerous conditions and circumstances.

PRIOR ART

U.S. Pat. No. 4,196,687, of Richard C. Newick, issued Apr. 8, 1990, discloses a luff roller reefing and roller furling system which provides a pocket built into the luff region of the sail, into which a foam pad is inserted. While the Newick system is generally effective, construction of the pocket in the sail is intricate and labor intensive. Insertion of the foam into the pocket is difficult. Most significantly, the Newick foam pad is confined inside the pocket, but is not fixed or bonded in place, and is vulnerable to deterioration of the foam, the sail fabric, and the stitching around the boundary of the pocket and seams of the sail panels across one face of the pocket, due to friction between the foam pad and the sail and pocket structure. The structure is also prone to the formation of wrinkles in partially furled or reefed conditions, which are aerodynamically undesirable.

SUMMARY OF THE INVENTION

A luff roller reefing and roller furling sail is provided with a luff pad made up of a laminate of a sail fabric adhesively bonded to one or both faces of a polyurethane elastomeric foam. The pad is adhesively bonded and/or stitched to the length of the luff, tapered from mid-luff to the tack and head. A luff tape is preferably adhesively bonded and stitched over each face of the laminate. When the sail is furled, the tapered luff pad provides bulk to cause more fabric to be drawn from the central portion of the sail, reducing draft and controlling position of the draft in partially furled or reefed conditions, and maintaining aerodynamically sound shape in the sail for windward performance.

DETAILED DESCRIPTION

In the present invention, a sail luff pad is provided for use in the construction of roller furling and roller reefing sails. It is simple and facile to use, economical of materials and labor, and highly effective and durable in use.

The luff pad is a deformable laminate of an elastomeric polyurethane foam core, faced on at least one side with an adhesively bonded layer of fabric or film, preferably of sail cloth. Both faces may be faced with sail cloth when desired.

Figure 1:
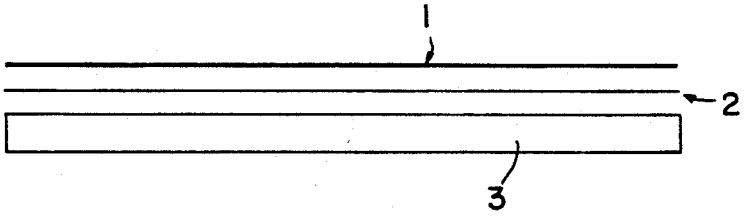
FIG. 1 is an exploded cross-sectional view illustrating the arrangement of parts in the luff pad laminate of the present invention.

In FIG. 1, the arrangement of parts in the luff pad laminate is shown. The foam core (3), is bonded to sail fabric (1) through the use of adhesive (2).

The laminate is generally from about 0.1 to 2.5 cm thick, in a width of from about 10 to 90 cm, and made in running lengths suitable to be cut to about the length of the luff of the sail to which the pad is to be applied. As those of ordinary skill in the art will recognize, thicker and wider laminates will often be desirable in larger sails, while thinner and narrower laminates will be more appropriate in smaller sails. A suitable all-round product will have a thickness of about 3 to 5 mm, and a width of about 20 to 40 cm. As will become apparent, the length may be "spliced" at the time of application if required.

The polyurethane core material may be generally any elastomeric polyurethane foam. A number of such materials are known and available. As a general rule, a relative firm foam is often desirable to avoid excessive compression when rolled on the stay on which the sail is set, but such considerations are not narrowly critical or significant to the invention. The foam must afford sufficient elasticity to accommodate the deformation required when the sail is furled and unfurled without cracking, breaking, or taking an excessive degree of set. Most elastomeric polyurethane foams will satisfy these criteria. It is generally preferred to select a suitable material among those commercially available in suitable dimensions, or which can readily be cut to suitable dimensions without substantial waste.

The facing on the foam may be any flexible and durable film or fabric. Film materials may be polyvinyl chloride, polyethylene terephthalate and the like, which may conveniently be plasticized to enhance their durability to flexural stress, and compounded with u.v. stabilizers to resist exposure to sunlight. In addition, any suitable fabric may also be employed, with polyesters, and particularly polyester sailcloth being most preferred.

The sail cloth fabric employed in the facing can be any available sail cloth, most often a square weave Dacron® polyester or the like for economy, ready availability, and convenience. The more specialized sail cloth materials, such as special weaves or exotic materials, are not required and the greater expense is generally not warranted, although such materials may be employed if desired. If such materials are employed, the sailmaker may be able to take advantages of specific properties in the design and construction of the sail. Such materials as Kevlar®, Spectra®, and the like, and such weaving techniques as triaxial, unbalanced, axial, and the like may be used, for example, although not required.

Sail cloth weights in the range of from as little as 1 ounce per yard and up to as much as 24 ounce per yard are available, and may be employed, although in most circumstances, extremes are neither required nor desirable. A conveniently and widely available, relatively light weight balanced weave fabric is most often preferred, such as a 2.5 ounce square weave Dacron® polyester. A heavier fabric may be preferred for larger sails.

It is preferred, but not required, that the fabric be uncoated, unsized, and scoured before use in forming the laminate of the present invention to maximize wetting and bonding of the laminating adhesive to the fibers of the cloth.

The weight of a fabric, including sail cloth, is usually specified in ounces per yard. This measurement is based on the weight of a running length of one yard of a fabric a standard 28 inches wide, and is a common industrial standard of measurement for fabric materials employed world-wide.

The laminating adhesive may be any of the elastomeric adhesives available which will effectively bond both the polyurethane foam and the polyester fabric. Elastomeric polyurethane adhesives are greatly preferred for their excellent bond strength, durability under stress, and their resistance to environmental degradation, from water, particularly sea water, heat, humidity, and sun. These are generally the same characteristics which make polyurethane elastomer foams the preferred materials for the laminate core. Other materials, particularly other synthetic polymer adhesives, and even foams, may be employed, but ordinarily only with some compromise in the properties of the laminate.

The greatest performance properties are, as a general rule, attained with polyurethane elastomer adhesives which cure at elevated temperature, with or without the application of moisture or other cure accelerators.

When the foam and facing materials permit, hot melt bonding may also be employed. As those of ordinary skill in the art will readily understand, the foam or the facing or both must be thermoplastic in order to employ thermal bonding. In such circumstances, the laminate of foam and facing may be conveniently formed on heated calendar rolls The laminating process to be employed is not narrowly significant to the invention, and may suitably be selected from any convenient technique known to those of ordinary skill in the art. Typically, the fabric and foam will be roll coated with the adhesive in separate operations, and the parts then brought together with the application of pressure and, if appropriate to the specific adhesive, heat, moisture, or other cure accelerators are applied. Passing the mated fabric and foam through the nip of a pair of rolls, with the nip set to a gap about half the thickness of the laminate, will generally be sufficient to attain a good wetting out of the fabric and foam with the adhesive, and assure freedom from air bubbles and the like.

As those of ordinary skill in the art will recognize, the cure reaction will continue at ambient conditions for some time. After about one week, the cure will ordinarily be in excess of ninety percent, and in many systems in excess of ninety eight percent, of full cure properties. It is accordingly preferred to store the laminate for at least about one week prior to use.

Figure 2:
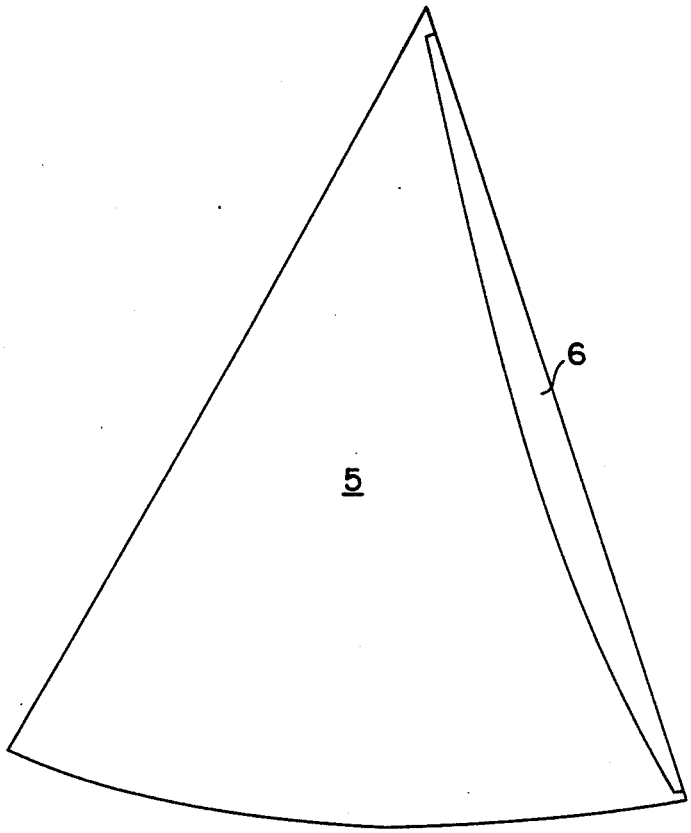
FIG. 2 is a side view of a rough sail blank, showing the laminate applied in a configuration suited to serve as a luff pad in accordance with the present invention.

The cured laminate will be applied to the sail during construction in most circumstances. FIG. 2 shows a side view of the rough sail blank (5) showing the laminate in a configuration suited to serve as luff pad (6). It is generally preferable to apply the foam pad to the sail blank, after the sail fabric panels are cut and seamed, by stitching or glueing and stitching, and application of reinforcing patches usually applied to head, tack and clew, but before final finishing operations, such as taping the luff, leach and foot, or the application of cringles, reinforcing straps, reef grommets, or the like.

In most circumstances, the luff pad is laid over the rough sail blank, and pinned in place on the loft floor. The pad is cut to a length substantially the length of the luff, generally within 5 to 15 cm from the tack and head. A suitable taper is formed, as by marking a smooth, fair curve on the laminate, which is then cut to shape with scissors or shears. It is convenient to mark the sail fabric with the layout of the laminate as an aid to registration when it is installed. The pad is then coated on the mating face, which is the foam face if the laminate is covered with fabric on only one side, and laid in registration with the marked position on the sail blank, and smoothed and pressed in place. A roller may help to remove entrained air bubbles, if needed. If the bonding adhesive is cured at elevated temperature, an iron may be employed to raise the temperature to a suitable point.

It is preferred that the pad be adhesively bonded to the sail blank, but if desired it may be temporarily fixed in place, by staples or pins or the like, and then stitched to the sail cloth.

The sail cloth will often bear a finish or sizing, and must be used in unscoured form. This will be significant in the selection of the adhesive to be employed in the bonding operation. It will generally be preferable to employ the adhesive recommended by the sail cloth manufacturer for glueing seams, particularly since the nature of sizings and finishes on sail cloth are often proprietary.

Once the pad is bonded in place and the adhesive has cured sufficiently to permit handling, it is generally preferable to also stitch the pad and sail together at the edges, in the usual form for seaming between panels in sail construction.

If a sufficient length of the foam laminate is not available for a single piece application, plural pieces may be applied in a "spliced" arrangement, by simply butting the joints between adjacent pieces. The joints, once bonded to the sail, should be stitched, and preferably double stitched along the joint. Other stitching across the width of the laminate pad is generally not preferred, although it may be appropriate in large sails.

After the laminate pad is in place, the sail may be finished in the usual fashion. When a luff tape is applied, it is desirable, and in most cases necessary, that it be bonded over the foam pad as well as the sail structure, where it is normally glued and stitched in place.

The finished sail can be handled like any other roller furling sail without regard to the laminate pad. When the sail if flaked in preparation for setting, it may be found that the luff bulk makes the sail a bit less handy, but significant problems are not created. Once the sail is hoisted on its stay, the luff is tensioned in the usual fashion. Sail handling under weigh is normal in every respect. When the stay is rotated to reef or furl the sail, there are no differences in the handling of the gear or its operation, but there will be a substantial improvement in the set of the sail in the partially furled or reefed condition.

As the stay rotates, the bulk of the laminate pad is greatest in the mid-luff region, and causes more material to be rolled onto the stay in that region. The sail thus does not increase in the depth of draft, and the draft is retained well forward, and very near the designed location (forward of mid-chord, and most often about 40% aft of the luff).

The details of the associated furling gear, the design of the sail, and other related parameters are not themselves a part of the present invention. They will vary from boat to boat. In general, however, usage of such a system may be described as follows:

When under sail to windward, in an increasing breeze, the vessel will heel to leeward in proportion to the wind strength. At some wind speed, which varies from boat to boat, the helmsman will be able to detect an increase in heel or weather helm or, most often, both which is excessive. The limit in weather helm is the most usual indicator of the point at which reefing is desirable (assuming the rig and sails are in proper tune and trim). When the decision is made to reef the roller furling sail, the sheet is eased, the roller furling gear is actuated for several rotations of the stay, and the sheet is then retrimmed to the newly reduced sail configuration. If weather helm or angle of heel are still excessive, further reefing rolls are taken. If boat speed drops, and heel and weather helm are modest, the sail may be partially or wholly unreefed, by a reversal of the reefing procedure.

BEST MODE

A Dacron ® polyester sail cloth of square weave and a weight of 2.5 ounces per yard was cut to a width of 20 cm and a running length was roll coated on one surface with a polyurethane elastomer adhesive.

A 0.2 cm thick polyurethane elastomer foam was cut to a width of 20 cm and a running length was roll coated on one surface with the polyurethane elastomer adhesive.

The adhesive coated faces of the fabric and the foam were mated and passed through the nip of a pair of heated calendar rolls set to a gap of 0.1 cm and a temperature of 140° C., and passed through a hot air oven maintained at a temperature of 120° C. with a residence time of 12 minutes.

The laminate was cooled by ambient air for five minutes after exiting the oven and then taken up on a roll and stored at ambient conditions for one week before use.

A roller reefing and roller furling Genoa jib was laid out on a sail loft floor, and the panels were cut, glued and stitched. A length of the luff pad laminate equal to the luff length was cut from the roll and laid over the luff of the roughed out sail and pinned to the floor. A batten was used to develop a fair taper marked on the pad, ranging from full width of 20 cm in the mid luff portions to 2 cm adjacent the tack and head. The taper was cut with shears, and the edges were marked on the sail for subsequent registration.

Figure 3:
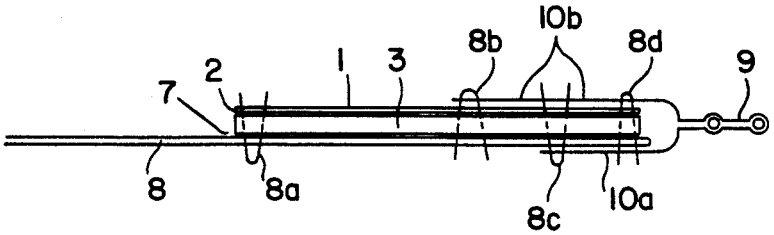
FIG. 3 is a stylized edge view of the luff region of a completed sail assembly according to the present invention, illustrating details of the construction.

The foam face of the laminate was coated with thin layer of an ambient curing polyurethane elastomer adhesive. The adhesive coated face of the pad was applied to the roughed out sail, in registration with the previously applied markings, and the adhesive was allowed to cure for about two hours. After the cure, the edges of the luff pad were stitched to the sail panels. The sail was then finished in the usual fashion. When the luff tape was applied, it was glued over and stitched through the pad as well as the sail fabric. The construction is illustrated in stylized form in FIG. 3, where the sandwich foam laminate (7), having facing (1), and adhesive bond (2) is applied over luff pad (3), and adhesively bonded in place. The assembly is stitched in place (8 *a*, 8*b*, 8*c*, 8*d*) including stitching through the luff tape (9) and luff pad (8*b*, 8*c*, 8*d*). Fabric elements (10*a*, 10*b*) of luff tape (9), of conventional form, overlie the front of the sail. Luff tape (9) is applied after the laminate is in place.

The sail was tested on a sail boat. Roller reefing and roller furling of the sail was normal in all respects, as was operation and performance in fully unfurled condition. When partially furled, i.e., reefed, the pad was observed to maintain a suitable aerodynamic shape for windward performance, without excessive draft in the center of the sail. The maximum depth of draft remained in substantially the same position as the fully unfurled sail, at about 45% of chord aft of the luff.

Repeated furling and unfurling in a variety of conditions, including wind strengths up to 30 knots, revealed no unusual behavior. The pad and sail remained in excellent condition over the course of trials.

What is claimed is:

1. A roller reefing and roller furling sail luff construction member adapted to be incorporated into the luff structure of a sail comprising a deformable sandwich laminate having a core of polyurethane foam and at least one face bonded to a facing of a film or fabric, said laminate having a thickness of from about 0.1 to about 2.5 cm, a length substantially equal to the length of the luff of the sail, and a width of from about 10 to about 90 cm.

2. The roller reefing and roller furling sail luff construction member of claim 1, wherein said facing is a woven sail fabric.

3. The roller reefing and roller furling sail luff construction member of claim 1 wherein said sail fabric is woven polyester.

4. The roller reefing and roller furling said luff construction member of claim 1 wherein said polyester has a weight of from about 1 to about 24 ounces per yard.

5. The roller reefing and roller furling sail luff construction member of claim 1 wherein said laminate is bonded by a flexible polyurethane adhesive.

6. The roller reefing and roller furling sail claim of 5 wherein said laminate is adhesively bonded to said sail fabric of said sail.

7. The roller reefing and roller furling sail of claim 5 wherein said laminate is stitched to said sail fabric of said sail.

8. The roller reefing and roller furling sail of claim 5 wherein said laminate is fixed along the luff of said sail to a luff tape.

9. The roller reefing and roller furling sail of claim 8 wherein said luff tape overlies at least a portion of the width of said laminate on both face surfaces.

10. A roller reefing and roller furling said supportable on a rotatable stay having a luff construction comprising a deformable sandwich laminate having a core of polyurethane foam and at least one face of sail fabric, said laminate having a thickness of from about 0.25 to about 1.5 cm, a length substantially equal to the length of the luff of the sail, and a width at about the mid-length of said luff of from about 10 to about 30 cm, and gradually tapered toward the head and tack, said laminate being fixed to the luff portion of the sail fabric of said sail.

11. The roller reefing and roller furling sail of claim 10 wherein said laminate is bonded b a flexible polyurethane adhesive.

* * * * *